US006698727B1

(12) United States Patent
Shaw

(10) Patent No.: US 6,698,727 B1
(45) Date of Patent: Mar. 2, 2004

(54) ELECTRONIC CONTROL DIAPHRAGM CARBURETOR

(75) Inventor: Scott R. Shaw, Brentwood, TN (US)

(73) Assignee: Zama Japan (JP)

( * ) Notice: Subject to any disclaimer, the term of this patent is extended or adjusted under 35 U.S.C. 154(b) by 0 days.

(21) Appl. No.: 10/294,215

(22) Filed: Nov. 13, 2002

Related U.S. Application Data

(63) Continuation-in-part of application No. 09/917,429, filed on Jul. 27, 2001, now Pat. No. 6,581,916.

(51) Int. Cl.[7] ..... F02M 17/04

(52) U.S. Cl. ..... 261/35; 123/438; 261/DIG. 68; 261/DIG. 74

(58) Field of Search ..... 261/35, 69.1, 69.2, 261/DIG. 68, DIG. 74; 123/438

(56) References Cited

U.S. PATENT DOCUMENTS

| | | | | |
|---|---|---|---|---|
| 2,774,582 A | | 12/1956 | Bracke | 261/41 |
| 3,174,730 A | | 3/1965 | Barr | 261/65 |
| 3,960,126 A | | 6/1976 | Shinoda | 123/120 |
| 3,978,175 A | | 8/1976 | Stoltman | 261/64.1 X |
| 4,092,380 A | | 5/1978 | Pierlot et al. | 261/64.1 |
| 4,117,812 A | | 10/1978 | Sato et al. | 261/64.2 X |
| 4,136,645 A | * | 1/1979 | Ito et al. | 123/684 |
| 4,167,547 A | * | 9/1979 | Takamaru et al. | 261/44.4 |
| 4,268,462 A | * | 5/1981 | Ota et al. | 261/40 |
| 4,290,399 A | | 9/1981 | Takada et al. | 123/439 |
| 4,314,535 A | | 2/1982 | Takeuchi et al. | 123/439 |
| 4,407,248 A | | 10/1983 | Takeuchi et al. | 123/439 |
| 4,472,323 A | * | 9/1984 | Showalter | 261/50.1 |
| 4,494,511 A | | 1/1985 | Ito et al. | 123/463 |
| 4,517,134 A | | 5/1985 | Nakamura et al. | 261/69.1 X |
| 4,572,134 A | * | 2/1986 | Nouthuka et al. | 123/438 |
| 4,579,097 A | | 4/1986 | Yamamoto et al. | 123/438 |
| 4,765,932 A | * | 8/1988 | Muraji | 261/27 |
| 4,787,356 A | | 11/1988 | Rösgen et al. | 123/438 |
| 5,465,698 A | * | 11/1995 | Benholz | 123/438 |
| 5,632,248 A | | 5/1997 | Sugii | 123/438 |
| 6,581,916 B1 | * | 6/2003 | Shaw | 261/35 |

OTHER PUBLICATIONS

* Rference is applicant's parent case SN 09/917,429.*

* cited by examiner

*Primary Examiner*—Richard L. Chiesa
(74) *Attorney, Agent, or Firm*—Orrick, Herrington & Sutcliffe LLP

(57) ABSTRACT

A diaphragm carburetor is disclosed wherein a mechanism for varying the fuel flow rate through the carburetor for delivery to the engine can be controlled by electronic feedback based on engine performance. A permanent magnet/wire coil assembly is attached to the diaphragm controlling the opening to the metering chamber within the carburetor. The assembly responds to commands based on engine performance and can vary the size of the opening to the metering chamber. In this way, the fuel flow rate through the carburetor can be modified to obtain the optimal fuel/air ratio for peak performance of the engine.

38 Claims, 1 Drawing Sheet

ELECTRONIC CONTROL DIAPHRAGM CARBURETOR

CROSS REFERENCE TO RELATED APPLICATION

This application is a continuation-in-part application of application Ser. No. 09/917,429 filed Jul. 27, 2001, now U.S. Pat. No. 6,581,916, which is incorporated herein by reference.

FIELD OF THE INVENTION

This invention relates to a diaphragm carburetor suitable for supplying fuel to an engine used as a power source for most handheld gasoline powered products. More particularly, the invention relates to devices and methods for allowing an inexpensive and effective means of electrical control of small engines offering functionality similar to that of auto engines.

BACKGROUND

Diaphragm carburetors are generally used to supply fuel to two-cycle engines. These carburetors are equipped with a fuel pressure regulator that ensures fuel fed from a fuel pump is regulated at a fixed pressure, and then delivered to an air intake path. The fuel pressure regulator is typically equipped with a constant-pressure fuel chamber that stores fuel sent from the fuel pump. The constant-pressure fuel chamber is generally separated from atmosphere by a diaphragm that adjusts the fuel pressure to a constant pressure. A control valve that is interlocked to the motion of the diaphragm opens and closes a fuel passageway through which fuel flows to the fuel chamber. Fuel from the fuel chamber is delivered to the air intake path via a main fuel path and an idle fuel path. The main fuel path leads to a main nozzle that is open to a venturi in the air intake path. The idle fuel path leads to slow and idle ports that open adjacent to a throttle valve in the air intake path.

Conventional diaphragm carburetors are pre-set at an equipment manufacturer's assembly line to deliver fuel at a predetermined flow rate to an engine the carburetor is coupled to. Manufacturing tolerances in the size and location of fuel paths, and the stiffness of the diaphragms, require that the manufacturer individually adjust each carburetor to achieve a desired flow rate. After these adjustments are made, all fuel path adjustment needles are capped to prevent subsequent tampering. The equipment is then shipped all over the world, and often times the carburetors are never readjusted to accommodate for local environmental conditions, fuel type or engine load.

This standardized manufacturing approach can lead to inefficient engine performance. Local environmental conditions, such as temperature and altitude, as well as engine loading and fuel type used can effect engine performance. All of these factors have an effect on the amount of fuel required for an optimal fuel/air ratio. The typical carburetor does not adjust for these variables, and the result is an engine that operates at less than peak performance and has higher exhaust emissions levels.

For example, engines operated in cold weather require additional fuel. Cold conditions inhibit fuel vaporization and cold air is denser, requiring additional fuel to achieve the proper fuel/air ratio. At higher altitudes, the air is less dense, and less fuel is required to obtain the proper fuel/air ratio. Typically, carburetors are set for peak performance at full load. However, when engines are run at less than peak power, less fuel is required. Lastly, different regions throughout the country, and the world, have different environmentally driven requirements for the amount of oxygenates that are added to fuel. Currently, engines are adjusted for optimal performance using the most oxygen rich fuels. Thus, when less-oxygenated fuels are used, excess fuel is used. Other conditions, including periods of start-up, warm-up, acceleration and deceleration, may also contribute to engine inefficiencies that could be corrected by varying the fuel flow rate to the engine.

Manufacturers have attempted to address this problem by placing a solenoid valve in a fuel passage through which fuel flows to the constant-pressure fuel chamber of the carburetor. The valve can be fully opened or fully dosed in response to electronic feedback generated from engine performance indicators. The problem with this device is that the resultant fuel path is either fully open or fully closed with no intermediate positions available.

Thus, it would be desirable to provide much finer control of the position of the fuel control valve to enable more accurate control of fuel delivery to the engine without a significant increase in cost or complexity of the device.

SUMMARY OF THE INVENTION

The proposed device of the present invention tends to facilitate much finer position control of a carburetor fuel flow control valve. This advantageously tends to result in more accurate control of fuel delivery to the engine without a significant increase in cost or complexity of the device.

In an exemplary embodiment of the present invention, a magnet and wire coil assembly are coupled to a metering diaphragm of the carburetor's fuel pressure regulator. The diaphragm, as with conventional diaphragm carburetors, contacts a lever that is connected to an inlet needle of a fuel control valve positioned in a passageway through which fuel flows to a constant pressure fuel chamber. Movement of the diaphragm controls the size of the opening of the control valve and, thus, fuel flow through the passageway to the constant-pressure fuel chamber. Preferably, the magnet is attached to the metering diaphragm and extends outside a bottom cover of the carburetor into the center of a wire coil that is attached to or is an integral part of the bottom cover.

Application of an electric current to the coil turns the coil into an electromagnet By controlling the direction and amount of current through the wire coil, the direction and degree to which the magnet travels can be controlled. Movement of the magnet, in turn, pushes or pulls the metering diaphragm inward and outward relative to the fuel chamber. In operation, the current flow through the coil is preferably modulated to provide either an inward bias or an outward bias on the diaphragm. An inward bias will cause the inlet needle to open further than normal and result in a greater amount of fuel being delivered to the engine. An outward bias will prevent the inlet needle from opening as far as normal and will result in less fuel being delivered to the engine. Thus, by controlling the current through the wire coil, one can control the amount of fuel flow through the carburetor and to the engine.

Electronic feedback generated from engine performance can be used to control the current input to the wire coil. In this way the engine will self-adjust so that the optimal fuel/air ratio will be achieved. This will result in lower exhaust emissions and improved engine performance.

Other objects and features of the present invention will become apparent from consideration of the following description taken in conjunction with the accompanying drawings.

DETAILED DESCRIPTION OF PREFERRED EMBODIMENT

Figure 1:
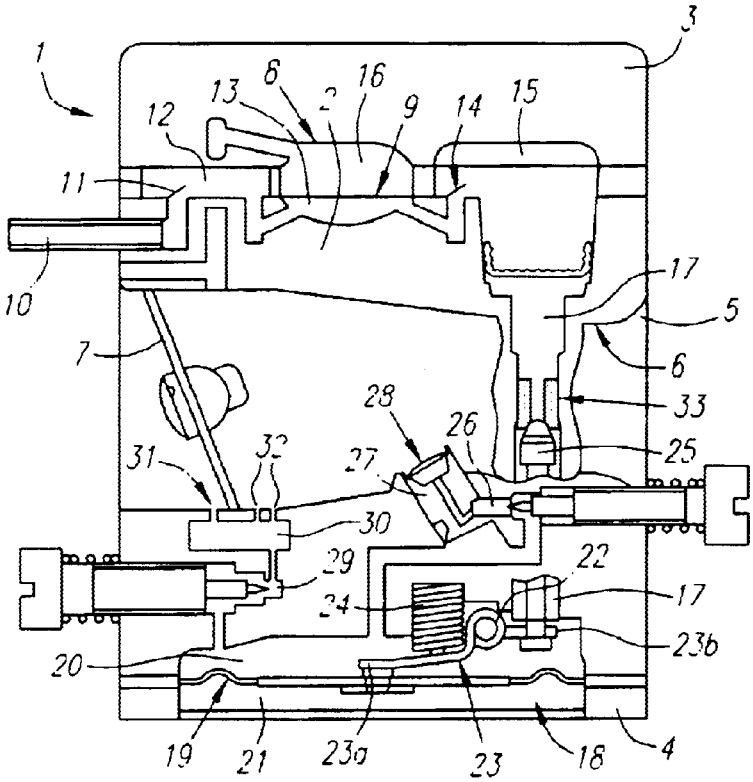
FIG. 1 (PRIOR ART)
FIG. 1 is a cut-away front view of a prior art carburetor having a fuel supply and control circuit.

Refering to FIG. 1, a prior-art carburetor having a fuel supply and control circuit is shown. The carburetor 1 includes a body 2 with an air intake path 5 that extends horizontally, and covers 3 and 4 mounted on the top and bottom of the body 2. The intake path 5 has a venturi 6 and a throttle valve 7 mounted upstream of the venturi 6.

A fuel pump diaphragm 9 of a fuel pump 8 is sandwiched between the body 2 of the carburetor 1 and the top cover 3. Fuel in a fuel tank (not shown) passes from a fuel pipe 10 through an inlet valve 11, an inlet chamber 12, a pump chamber 13, an outlet valve 14, and an outlet chamber 15, and is fed, via a fuel path 17 to a metering or constant-pressure fuel chamber 20 of a fuel pressure regulator 18. A pulse pressure generated in an engine crankcase is introduced into a pulse chamber 16 which opposes a pump chamber 13 (both of which sandwich the fuel pump diaphragm 9), which causes the fuel to be sucked into the pump chamber 13, from which it is dispensed, all of which is generally known in the art.

A metering diaphragm 19 of a fuel pressure regulator 18 is sandwiched between the body 2 and the bottom cover 4 of the carburetor 1, and divides the fuel chamber 20 above from an air chamber 21 below. A lever 23, which is housed in the fuel chamber 20 and supported in free rotation by a pin 22, is biased by a spring 24 so one end 23*a* of the lever 23 contacts the center of the metering diaphragm 19. At the other end 23*b*, the lever 23 supports an inlet needle 25 of a fuel control valve 33 that opens and doses the fuel path 17. When the pressure drops in the fuel chamber 20 as fuel is fed from the chamber 20 into the air intake 5, the metering diaphragm 19 is biased upward, biasing the inlet needle 25 downward or away from the control valve 33 to open the control valve 33 and allow fuel to flow through the fuel path 17 into the fuel chamber 20. When the pressure rises in the fuel chamber 20 due to the flow of fuel into the chamber 20, the metering diaphragm 19 is biased downward, biasing the inlet needle 25 upward or toward the control valve 33 to close the control valve 33. In this manner, the fuel chamber 20 is always kept at a constant pressure.

The fuel from the fuel chamber 20 enters a nozzle chamber 27 via a main fuel path 26. The fuel is fed from the nozzle chamber 27 to the air intake path 5 through a main nozzle 28 that opens into the venturi 6 of the air intake path 5. The fuel from the fuel chamber 20 also enters a port chamber 30 via an idle fuel path 29. Depending on the position of the throttle valve 7, the fuel is fed from the port chamber 30 into the air intake path 5 through an idle port 31 or part throttle ports 32 adjacent to the throttle valve 7.

Figure 2:
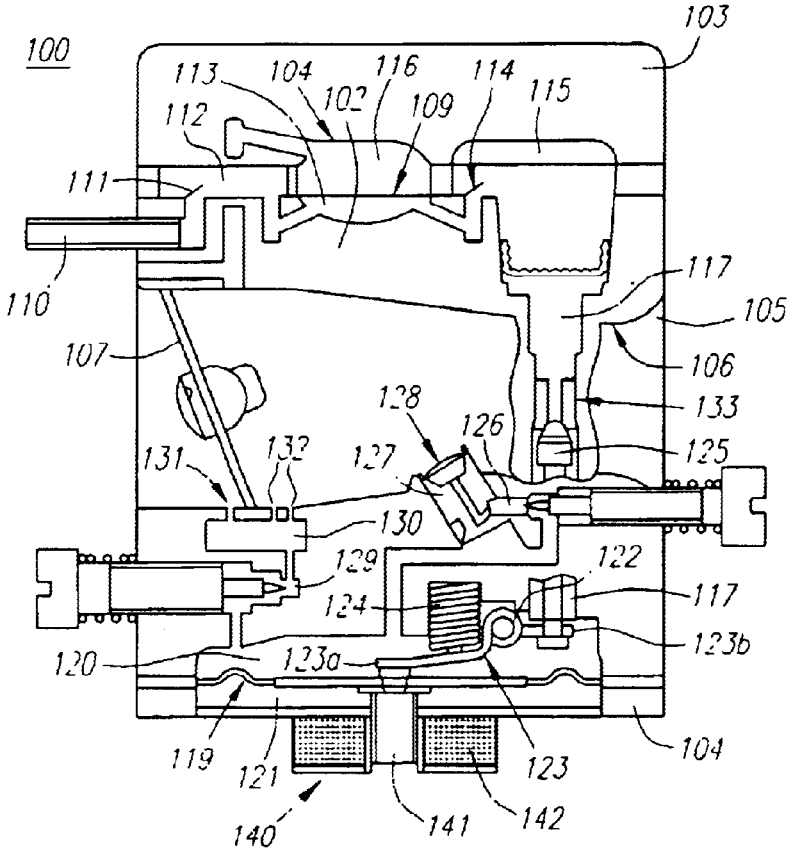
FIG. 2 is a cut-away front view of a carburetor having a fuel supply and control circuit constructed in accordance with the teachings of the present invention.

Turning to FIG. 2, a preferred embodiment of a carburetor 100 having a fuel supply and control circuit constructed in accordance with the present invention is shown. As with a conventional carburetor 1 described above, the carburetor 100 of the present invention includes a body 102 with an air intake path 105 that extends horizontally, and covers 103 and 104 mounted on the top and bottom of the body 102. The intake path 105 has a venturi 106 and a throttle valve 107 mounted upstream of the venturi 106.

A fuel pump diaphragm 109 of a fuel pump 108 is sandwiched between the body 102 of the carburetor 100 and the top cover 103. Fuel in a fuel tank (not shown) passes from a fuel pipe 110 through an inlet valve 111, an inlet chamber 112, a pump chamber 113, an outlet valve 114, and an outlet chamber 115, and is fed, via a fuel path 117 to a metering or constant-pressure fuel chamber 120 of a fuel pressure regulator 118. A pulse pressure generated in an engine crankcase is introduced into a pulse chamber 116 which opposes the pump chamber 113 (both of which sandwich the fuel pump diaphragm 109), which causes the fuel to be sucked into the pump chamber 113.

A metering diaphragm 119 of a fuel pressure regulator 118 is sandwiched between the body 102 and the bottom cover 104 of the carburetor 100, and divides the fuel chamber 120 above from an air chamber 121 below. A lever 123, which is housed in the fuel chamber 120 and supported In free rotation by a pin 122, is biased by a spring 124 so one end 123*a* of the lever 123 contacts the center of the metering diaphragm 119. The other end 123*b* of the lever 123 supports an inlet needle 125 of a control valve 133 that opens and closes the fuel path 117. When the pressure drops in the fuel chamber 120 as fuel is fed from the fuel chamber 120 into the air intake path 105, the metering diaphragm 119 is biased upward, biasing the inlet needle 125 downward or away from the control valve 133 to open the control valve 133 and allow fuel to flow through the fuel path 117 to the fuel chamber 120. When the pressure rises in the fuel chamber 120, the metering diaphragm 119 is biased downward, biasing the inlet needle 125 upward or toward the control valve 133 to dose the control valve 133. In this manner, the fuel chamber 120 is always kept at a constant pressure.

The fuel from the fuel chamber 120 enters a nozzle chamber 127 via a main fuel path 126. The fuel is fed from the nozzle chamber 127 to the air intake path 105 through a main nozzle 128 that opens into the venturi 106 of the air intake path 105. The fuel from the fuel chamber 120 also enters a port chamber 130 via an idle fuel path 129. Depending on the position of the throttle valve 107, the fuel is fed from the port chamber 130 into the air intake path 105 through an idle port 131 or part throttle ports 132 adjacent to the throttle valve 107.

However, to accommodate variations in local environmental conditions, fuel type or engine load, the carburetor 100 of the present invention includes a supplement fuel flow control device comprising a magnet and coil assembly 140 coupled to the metering diaphragm 119. The magnet 141, which is preferably a permanent magnet, attaches to the metering diaphragm 119. The magnet 141 extends from the diaphragm 119 out of the pressure regulator 118 through the bottom cover 104 and through the center of a wire coil 142 that is attached to the bottom cover 104 of the carburetor 100. Alternatively, the wire coil 142 may be formed as an integral part of the bottom cover 104.

Application of an electric current to the wire coil 142 turns the coil 142 into an electromagnet. By controlling the direction and amount of current through the wire coil 142, the direction and degree to which the magnet 141 travels can be controlled. Movement of the magnet 141, in turn, pushes or pulls the metering diaphragm 119 inward and outward relative to the fuel chamber 120. In operation, the current flow through the coil 142 is preferably modulated to provide either an inward bias or an outward bias on the diaphragm 119. An inward bias will cause the inlet needle 125 to open further than normal and result in a greater amount of fuel being delivered to the engine. An outward bias will prevent the inlet needle 125 from opening as far normal and will result in less fuel being delivered to the engine. In this way, the amount of fuel entering metering chamber 120, and ultimately reaching the engine, can be varied.

The magnet and wire coil assembly 140 can be used to override the normal pressure activated movement of metering diaphragm 119. For example, the magnet and wire coil assembly 140 can be activated in cold conditions to apply an inward bias to the metering diaphragm 119 to increase fuel flow to the air intake path 105 to achieve the proper fuel/air ratio. At higher altitudes, the magnet and wire coil assembly 140 can be activated to apply an outward bias to the metering diaphragm 119 to decrease fuel flow to the air intake path 105 to achieve the proper fuel/air ratio. When engines are run at less than peak power, the magnet and wire coil assembly 140 can be activated to apply an outward bias to the metering diaphragm 119 to decrease fuel flow to the air intake path 105 to achieve the proper fuel/air ratio. However, if there is no electrical current running through the wire coil, then the metering diaphragm 119 will maintain a constant pressure within metering chamber 120, just as the pressure regulator diaphragm 19 maintains a constant fuel pressure in fuel chamber 20 in a conventional carburetor 1 discussed above.

In a preferred embodiment, the control valve 133 can be controlled from fully open to fully closed and all intermediate positions there between. The primary limitation on the position of the control valve 133 is the degree to which the current through the wire coil 142 can be controlled. The fuel flow control device 140 is easily adaptable to operate with an engine's control system and utilize the engine's response to a control input as a sensor. Electronic feedback generated from engine performance is then used to control the current input to the wire coil 142. In operation, a control system will typically input a pre-programmed mixture change as the engine is running and then analyze the engine's response. For example, in a "skip fire" control system, fuel is shut off for one revolution every 100 revolutions. By interpreting the engine's rpm change during the "fuel off" cycle the control system can determine if the engine is running richer or leaner than optimum and adjust the current to the wire coil 142 to adjust the fuel flow accordingly. In this way the engine will self-adjust so that the optimal fuel/air ratio will be achieved.

In another preferred embodiment, the diaphragm carburetor 100 is operated in conjunction with a two-stroke engine. Alternatively, the carburetor 100 may be operated in conjunction with a four-stroke engine.

In an alternative embodiment, the coil and magnet assembly 140 may be used as a sensor in the system of the present Invention. As a permanent magnet 141, any motion of the magnet 141 within the coil 142 will generate an electric current. Motion of the magnet can be induced either by the normal pressure actuated inward deflection of the metering diaphragm 119 on each fuel intake stroke, or by the vibration of the magnet 141 and diaphragm 119 during engine operation. In either case, the electric current induced in the coil 142 can be sensed and used as a signal to determine the speed of the engine. An engine controller (not shown) may use the signal to control the speed of the engine.

Although the teachings of this invention have been illustrated with specific examples and embodiments to enable one skilled in the art to make and use the invention, it is equally apparent that many more embodiments, applications and advantages are possible without deviating from the inventive concepts disclosed, described, and claimed herein. The invention, therefore, should only be restricted in accordance with the spirit of the claims appended hereto or their legal equivalent, and it is not to be restricted by the specification, drawings, or the description of the preferred embodiment.

What is claimed is:

1. A method of fuel flow control in a diaphragm carburetor, comprising the steps of:

maintaining a constant pressure fuel chamber separated from an air chamber by a metering diaphragm at a predetermined constant pressure, and overriding air pressure activated movement of the metering diaphragm by inwardly and outwardly biasing the metering diaphragm to increase and decrease fuel flow from the constant pressure fuel chamber into an air intake path.

2. The method of claim 1 wherein the overriding step includes inwardly biasing the metering diaphragm.

3. The method of claim 2 further comprising increasing fuel flow from the fuel chamber into the air intake path.

4. The method of claim 3 further comprising biasing a fuel control valve in the opened direction.

5. The method of claim 4 further comprising increasing fuel flow into the constant pressure fuel chamber.

6. The method of claim 1 wherein the overriding step includes outwardly biasing the metering diaphragm.

7. The method of claim 6 further comprising decreasing fuel flow from the fuel chamber into the air intake path.

8. The method of claim 7 further comprising biasing a fuel control valve in the closed direction.

9. The method of claim 8 further comprising decreasing fuel flow into the constant pressure fuel chamber.

10. The method of claim 1 wherein the overriding step includes controlling the position of a fuel control valve from fully opened to fully dosed and intermediate positions there between.

11. The method of claim 1 wherein the overriding step includes controlling the position of a position control member attached to the metering diaphragm.

12. The method of claim 11 wherein the position control member is a magnet.

13. The method of claim 12 wherein a wire coil surrounds the magnet and the magnet is movable relative to the wire coil in response to an electric current passing through the coil.

14. The method of claim 13 wherein the overriding step includes passing an electric current through the coil.

15. The method of claim 14 further comprising controlling the direction and amount of current passing through the coil.

16. The method of claim 15 further comprising controlling the direction and degree to which the magnet travels relative to the coil.

17. The method of claim 14 further comprising modulating the current through the coil to provide either an inward bias or an outward bias on the metering diaphragm.

18. The method of claim 14 further comprising sensing engine performance and controlling the direction and amount of current passing through the coil in response to the engine performance.

19. The method of claim 14 further comprising stopping the flow of current through the coil and maintaining the predetermined constant pressure in the constant pressure fuel chamber.

20. A method of fuel flow control in a diaphragm carburetor, comprising the steps of:

controlling the position of a position control member comprising a magnet surrounded by a wire coil, the magnet being movable relative to the wire coil in response to an electric current passing through the coil, and biasing a metering diaphragm in a fuel chamber attached to the magnet inwardly and outwardly to increase and decrease fuel flow from the fuel chamber into an air intake passage, passing an electric current through the coil, and controlling the direction and amount of current passing through the coil.

21. The method of claim 20 further comprising controlling the direction and degree to which the magnet travels relative to the coil.

22. A method of fuel flow control in a diaphragm carburetor, comprising the steps of:

controlling the position of a position control member comprising a magnet surrounded by a wire coil, the magnet being movable relative to the wire coil in response to an electric current passing through the coil, and biasing a metering diaphragm in a fuel chamber attached to the magnet inwardly and outwardly to increase and decrease fuel flow from the fuel chamber into an air intake passage, passing an electric current through the coil, and modulating the current through the coil to provide either an inward bias or an outward bias on the metering diaphragm.

23. A method of fuel flow control in a diaphragm carburetor, comprising the steps of:

controlling the position of a position control member comprising a magnet surrounded by a wire coil, the magnet being movable relative to the wire coil in response to an electric current passing through the coil, and biasing a metering diaphragm in a fuel chamber attached to the magnet inwardly and outwardly to increase and decrease fuel flow from the fuel chamber into an air intake passage.

passing an electric current through the coil, and sensing engine performance and controlling the direction and amount of current passing through the coil in response to the engine performance.

24. A method of fuel flow control in a diaphragm carburetor, comprising the steps of passing electric current through a wire coil surrounding a magnet, the magnet being attached to a metering diaphragm in a fuel chamber, and controlling the direction and amount of current passing through the coil to control the direction and degree the magnet travels relative to the coil for biasing the metering diaphragm inwardly and outwardly.

25. The method of claim 24 further comprising biasing the metering diaphragm inwardly and outwardly to increase and decrease fuel flow from the fuel chamber into an air intake passage.

26. The method of claim 24 further comprising modulating the current through the coil to provide either an inward bias or an outward bias on the metering diaphragm.

27. The method of claim 24 further comprising sensing engine performance and controlling the direction and amount of current passing through the coil in response to the engine performance.

28. The method of claim 24 further comprising inwardly biasing the metering diaphragm.

29. The method of claim 28 further comprising increasing fuel flow from the fuel chamber into an air intake path.

30. The method of claim 29 further comprising biasing a fuel control valve in the opened direction.

31. The method of claim 30 further comprising increasing fuel flow into the fuel chamber.

32. The method of claim 24 further comprising outwardly biasing the metering diaphragm.

33. The method of claim 32 further comprising decreasing fuel flow from the fuel chamber into an air intake path.

34. The method of claim 33 further comprising biasing a fuel control valve in the closed direction.

35. The method of claim 34 further comprising decreasing fuel flow into the fuel chamber.

36. The method of claim 24 further comprises controlling the position of a fuel control valve from fully opened to fully closed and intermediate positions there between.

37. The method of claim 27 further comprising inputting a pre-programmed mixture change as the engine is running, and analyzing the engine's response.

38. The method of claim 37 further comprising shutting off fuel flow to the engine, interpreting the engine's rpm change during the "fuel off" cycle to determine if the engine is running richer or leaner than optimum, and adjusting the current to the wire coil to adjust the fuel flow.

* * * * *